US006257697B1

(12) United States Patent
Kurata

(10) Patent No.: US 6,257,697 B1
(45) **Date of Patent: *Jul. 10, 2001**

(54) FLUID EJECTING APPARATUS, A PRINT SYSTEM, A METHOD OF RECOVERING FLUID FROM A FLUID EJECTING HEAD, AND A RECORD PRODUCT ALL INCLUDING A WIPING BLADE FOR WIPING AN EJECTION SURFACE

(75) Inventor: Mitsuru Kurata, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/400,826

(22) Filed: Mar. 8, 1995

(30) Foreign Application Priority Data

Mar. 9, 1994 (JP) ..... 6-038619

(51) Int. Cl.[7] ..... B41J 2/165

(52) U.S. Cl. ..... 347/33; 347/30; 347/31

(58) Field of Search ..... 347/33, 28, 30, 347/31, 29, 84, 85, 89, 36, 32; 342/28, 31, 33; 400/701, 702.1; 354/299

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,364,065 | * | 12/1982 | Yamamori et al. | 347/28 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 5,068,681 | * | 11/1991 | Kosugi et al. | 354/299 |
| 5,552,811 | * | 9/1996 | Kurata | 347/28 |

FOREIGN PATENT DOCUMENTS

| | | | | |
|---|---|---|---|---|
| 3042998 | * | 1/1982 | (DE) | B41J/3/04 |
| 54-56847 | | 5/1979 | (JP) . | |
| 59-123670 | | 7/1984 | (JP) . | |
| 59-138461 | | 8/1984 | (JP) . | |
| 60-71260 | | 4/1985 | (JP) . | |
| 62-53492 | | 3/1987 | (JP) . | |
| 62-154855 | | 10/1987 | (JP) . | |
| 2-72961 | | 3/1990 | (JP) . | |
| 2-155654 | | 6/1990 | (JP) . | |
| 3-46589 | | 7/1991 | (JP) . | |
| 404278358 | * | 10/1992 | (JP) | 347/33 |
| 5212851 | | 8/1993 | (JP) . | |
| 6-5957 | | 1/1994 | (JP) . | |
| 6-79880 | | 3/1994 | (JP) . | |
| 6-328705 | | 11/1994 | (JP) . | |

OTHER PUBLICATIONS

Nozzle Guard and Maintenance Station for Drop–On–Demand Printheads. IBM Techical Disclosure Bulletin, vol. 27 No. 12, pp. 6965–6967, May 1985.*

* cited by examiner

*Primary Examiner*—Thinh Nguyen
(74) *Attorney, Agent, or Firm*—Fitzpatrick, Cella, Harper & Scinto

(57) ABSTRACT

A fluid-ejecting apparatus includes: a wiping device having a wipe member for wiping an ejection surface of a fluid-ejecting head; and a washing bath storing a wash fluid for washing at least the wipe member of the wiping device. Therefore, a stable and uniform washing of the wiping device can be performed.

32 Claims, 8 Drawing Sheets

FLUID EJECTING APPARATUS, A PRINT SYSTEM, A METHOD OF RECOVERING FLUID FROM A FLUID EJECTING HEAD, AND A RECORD PRODUCT ALL INCLUDING A WIPING BLADE FOR WIPING AN EJECTION SURFACE

BACKGROUND OF THE INVENTION

1. Field of the Invention

The present invention relates to an image-forming apparatus used for performing an image formation operation on a recording medium (a printing medium), especially using a cloth as the recording medium. More specifically, the invention relates to a fluid-ejecting apparatus employing an ink-jet printing head for ejecting a fluid, such as ink, onto the cloth to perform textile printing. Furthermore, the present invention also relates to an information-processing system, such as a textile-printing system, using such apparatus as an output device.

2. Description of the Related Art

Heretofore, an ink-jet recording method has been used in output means of data-processing systems. The output means have been provided as printers, as output terminals of copying machines, facsimile machines, printing machines, word processors, work stations, or the like, or provided as handy- or portable printers, for personal computers, host computers, optical disc- or video-equipment, or the like. The ink-jet recording method comprises the step of forming an image of input data of characters, pictures, drawings or the like on a recording medium (e.g., a sheet of paper, an OHP sheet, or a cloth) by directly ejecting minute ink droplets from minute nozzles. Therefore, the ink-jet recording method has several advantages over the others in that it provides excellent image qualities and performs high-speed printing. In addition, a recording apparatus using the ink-jet recording method (hereinafter, also referred to as an ink-jet recording apparatus) is of a non-impact type, so that it performs printing without causing unpleasant noise. Besides, it easily performs full-color printing by using different color inks. Furthermore, it is easy to down size the ink-jet recording apparatus and also it is easy to provide high-density images by using such apparatus.

Accordingly, the ink-jet recording method can be applied not only in the field of data-processing but also extensively in fields using an ink-supporting medium (e.g., a sheet of paper, an OHP sheet, or a cloth) to be given ink or the like, such as the textile and clothing industries.

In the textile field and the clothing industries, the ink-jet method can be used in a textile-printing system comprising an ink-jet fluid-ejecting apparatus (a textile-printing apparatus) as an output device. The ink-jet textile-printing apparatus has several advantages over the others in that it performs image-printing with more complete control and with a lower total cost because it does not require a negative plate of an image to be printed. In the case of screen-printing, on the other hand, a costly plate can be required and the printing can be performed beyond the limits.

One of the conventional ink-jet textile-printing apparatuses is disclosed in Japanese Patent Application Laid-open No. 212851/1993. In FIG. 2 of the reference, the textile-printing apparatus comprises a printer unit having nozzle heads and a transport mechanism for transporting a recording medium, such as a cloth. The nozzle head ejects ink droplets against the cloth to be transported in the vertical direction to print an image thereon. That is, the nozzle head ejects ink droplets in the horizontal direction. In the area in which printing is performed by ejecting ink droplets, the printer unit, having the nozzle heads, is mounted so as to face the transport mechanism having an endless belt. In this case, the fabric is provided at a location between them. In general, furthermore, the printer unit is mounted in the textile-printing apparatus so as to smoothly move in the horizontal direction and also so as to shift its position or the like to make it possible to adjust the distance between the unit and the fabric or to replace the endless belt. In general, by the way, it is natural that the printing devices should be improved so as to print images on the recording medium at a higher speed, not excepting the ink-jet textile-printing apparatus, as a logical consequence.

For directly realizing high-speed printing on a fabric having a relatively long length and width or on a long cloth continuously provided by the transport mechanism, there is an attempt to increase the number of orifices arranged on the ink-jet head. In this case, it can be achieved by setting a long-sized head. That is, it means that the long-sized head extends in the direction of transporting the recording medium, such as a cloth, and comprises an increased number of the orifices arranged in that direction. Therefore, the width of one line to be printed by one scanning movement of the long-sized head is greater than that of a normal one. In general, the distance of shifting the recording medium by the transporting mechanism corresponds to a width of a line to be recorded, so that the printing speed can be improved by increasing the above distance in accordance with the line's width.

In the case of the textile-printing apparatus, as disclosed in the above reference, the long-sized printing head leads to a comparatively great difference among the water heads of the orifices because these orifices are arranged in the vertical direction. It is noted that such difference leads to a different volume of an ink droplet to be ejected from each orifice, resulting in the deterioration of image-qualities.

In the case of the textile-printing apparatus, as disclosed in Japanese Patent Application Laid-Open No. 31905/1993, on the other hand, a printing head is installed in the device so as to eject ink droplets vertically from a higher to a lower place. In this case, therefore, the orifices are arranged in a horizontal direction, so that there is no difference among their water heads in general, thereby avoiding the problem.

Furthermore, the above recording head facing downward has an effect on the ability to recover ejected ink droplets from each orifice by absorbing ink therefrom or by other means. In addition, it also has an effect on preventing a water drop, attached on an ejection surface of the recording head, from entering into the orifice.

In spite of the above advantages, the printing apparatus, having a printing head facing downward without any improvement may cause several troubles as a result of its particular configuration.

For the conventional textile-printing apparatus, a head-recovering means using a wash fluid can be employed because the concentration of dye in the ink being specified for the print is higher than that of the ink used in the other kind of the image-forming apparatus. In textile-printing, the specified dye is easily precipitated by evaporating the water content of the ink. Japanese Patent Application Laid-Open No. 79880/1994 discloses an ink-jet textile-printing apparatus employing one of the conventional examples of the above means. In the reference, the recovery of ejected ink droplets of an ink-jet printing head can be performed by the excellent recovering means. That is, the recovering means performs a process that comprise the steps of: washing a cleaning blade made of a porous material by dropping wash fluid (i.e., wash water); sucking the wash water absorbed in the blade by a suction pump; and wiping off the ink-jet printing head to prevent the above dye precipitation. In the case that the printing head is installed in the device so as to front on downward, a longitudinal direction of the printing head is horizontally arranged. In the same way as the other conventional constructions, therefore it is difficult to wash a whole surface of the cleaning blade elongated in the longitudinal direction by the wash fluid dropping from a single nozzle. In the conventional device, furthermore, it is also difficult to wash the whole surface of the cleaning blade because of uneven running of the wash fluid. Conventionally, therefore, the conventional printing apparatus has been complicated in structure because of several attempts to avoid the above problem, by providing a plurality of nozzles for running the wash fluid on the blade in the longitudinal direction thereof, and moving the nozzles along the blade in the predetermined direction. In proportion to the length of the ink-jet head and the cleaning blade, furthermore, the attempts lead to the growing use of wash water and result in a rising cost of running the device. That is, the rate of running the wash water may be almost 10 cubic centimeter per 3 seconds for washing a head of 16 mm in print width. In spite of the great quantity of wash water, only a part thereof substantially contributes to remove dirty materials from the blade.

Accordingly, there has been a demand for a novel fluid-ejecting apparatus which is able to wash a cleaning blade easily and perfectly with a smaller use of the wash water, and also a novel information-processing system, such as a textile-printing system using such apparatus as an output printing means.

SUMMARY OF THE INVENTION

It is an object of the invention to provide a novel fluid-ejecting apparatus which is able to wash a cleaning blade easily and perfectly, and also a novel textile-printing system using such apparatus as a means of printing.

Another object of the invention is to provide a fluid-ejecting apparatus with the smaller use of wash water for a cleaning blade, and also a novel textile-printing system using such apparatus as a means of printing.

A further object of the present invention is to provide a fluid-ejecting apparatus with a stable washing of a cleaning blade, and also a novel textile-printing system using such apparatus as a means of printing.

In a first aspect of the present invention, there is provided a fluid-ejecting apparatus for ejecting a specified fluid to a recording medium by using a fluid-ejecting head having an ejection surface where a plurality of orifices for ejecting the specified fluid is formed comprising: a wiping means having a wipe member for wiping the ejection surface; and a washing bath storing a wash fluid for washing at least the wipe member of the wiping means.

Here, the apparatus may further comprise: a transport means for moving the wiping means, by which the wiping means moves between a first position, where the wipe member wipes the fluid-ejecting head, and a second position, where at least the wipe member is washed by the wash fluid.

The apparatus may further comprise: a supply means for supplying an additional wash fluid to the washing bath.

The apparatus may further comprise: a discharge means for discharging a portion of the wash fluid when the content of the wash fluid in the washing bath exceeds a prescribed level.

The wipe member may be made of a plastic member.

The plastic member may be a high molecular porous body of the type keeping its volume constant after absorbing the fluid, and preferably the high molecular porous body is a formal foam resin.

The plastic member may be a thermal sintered compound selected from low-density polyethylene, high-density polyethylene, high-molecular polyethylene, complex polyethylene, polypropylene, polymethyl meta-acrylate, polystyrene, acrylonitrile copolymer, ethylene/vinyl acetate copolymer, fluororesin, and phenol resin.

The washing means may comprise an absorption means for absorbing the fluid in the wipe member.

The absorption force of the absorption means may be enough to cause the fluid to flow from the orifices of the fluid-ejecting head through the wiping means when the ejection surface is wiped by the wiping member.

The fluid-ejecting head may be moved back and forth against a recording surface of the recording medium to be recorded by ejection of the fluid, and the wipe means has a first surface for wiping the ejection surface of the fluid-ejecting head at the time of moving the fluid-ejecting head forth, and a second surface for wiping, for wiping the ejection surface of the fluid-ejecting head at the time of moving the fluid-ejecting head back.

The fluid-ejecting head may be of the type for performing full color recording, composed of a plurality of head portions being different from each other to correspond a plurality of different colors.

The fluid-ejecting head may be an ink-jet recording head having a plurality of nozzle for ejecting the fluid.

The ink-jet recording head may have a plurality of thermal-energy conversion elements for generating thermal energies to be applied in the fluid to perform the ejection.

The fluid-ejecting head may eject the fluid from the orifice by causing a conditional change of the fluid by the thermal energy to be generated by the thermal-energy conversion element.

The recording medium may be a cloth.

According to a second aspect of the present invention, there is provided a print system comprising a textile-printing apparatus and a control device for controlling the print device, wherein the textile-printing apparatus has: a wiping means having a wipe member for wiping an ejection surface of the textile-printing apparatus; and a washing bath storing a wash fluid for washing at least the wipe member of the wiping means.

According to a third aspect of the present invention, there is provided a method of recovering a fluid-ejecting head for ejecting a specified fluid to a recording medium, comprising the steps of: wiping an ejection surface of the fluid-ejecting head by a wipe member of a wiping means; and washing at least the wipe member of the wiping means by immersing it in a wash fluid in a washing bath.

The method may further comprise the step of: moving the wiping means between a first position, where the wipe member wipes the fluid-ejecting head, and a second position where at least the wipe member is washed by the washing fluid.

The method may further comprise the step of: supplying an additional wash fluid to the washing bath.

The method may further comprise the step of: discharging a portion of the wash fluid when the content of the wash fluid in the washing bath exceeds a prescribed level.

The wipe member may be made of a plastic member.

The plastic member may be a high molecular porous body of the type keeping its volume constant after absorbing the fluid, and preferably the high molecular porous body is a formal foam rein.

The plastic member may be a thermal sintered compound selected from low-density polyethylene, high-density polyethylene, high-molecular polyethylene, complex polyethylene, polypropylene, polymethyl meta-acrylate, polystyrene, acrylonitrile copolymer, ethylene/vinyl acetate copolymer, fluororesin, and phenol resin.

The washing means may comprise an absorption means for absorbing the fluid in the wipe member.

The absorption force used in the absorption step may be enough to cause the fluid to flow from the orifices of the fluid-ejecting head through the wiping means when the ejection surface is wiped by the wiping means.

The fluid-ejecting head may be moved back and forth against a recording surface of the recording medium to be recorded by ejection of the fluid, and the wipe means has a first surface for wiping the ejection surface of the fluid-ejecting head at the time of moving the fluid-ejecting head forth, and a second surface for wiping, for wiping the ejection surface of the fluid-ejecting head at the time of moving the fluid-ejecting head back.

The fluid-ejecting head may be of the type for performing full color recording, composed of a plurality of head portions being different from each other to correspond to a plurality of different colors.

The fluid-ejecting head may be an ink-jet recording head having a plurality of nozzles for ejecting the fluid.

The ink-jet recording head may have a plurality of thermal-energy conversion elements for generating thermal energies to be applied in the fluid to perform the ejection.

The fluid-ejecting head may eject the fluid from the orifice by causing a conditional change of the fluid by the thermal energy to be generated by the thermal-energy conversion element.

The recording medium may be a cloth.

According to a fourth aspect of the present invention, there is provided a record product comprising a recording medium and a plurality of fluid droplets forming an image on at least one surface of the recording medium, wherein the fluid droplets are ejected by a fluid-ejecting apparatus having: a wiping means having a wipe member for wiping an ejection surface of the textile-printing apparatus, and a washing bath storing a wash fluid for washing at least the wipe member of the wiping means.

The above and other objects, effects, features, and advantages of the present invention will become more apparent from the following description of embodiments taken thereof in conjunction with the accompanying drawings.

BRIEF DESCRIPTION OF THE DRAWINGS

Embodiments of the invention will now be described, by way of example, and with reference to the accompanying drawings in which.

DETAILED DESCRIPTION OF A PREFERRED EMBODIMENT

The present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessarily obscure the present invention.

EXAMPLE 1

A general construction of a textile-printing apparatus in accordance with the present invention will be described below.

Figure 1:
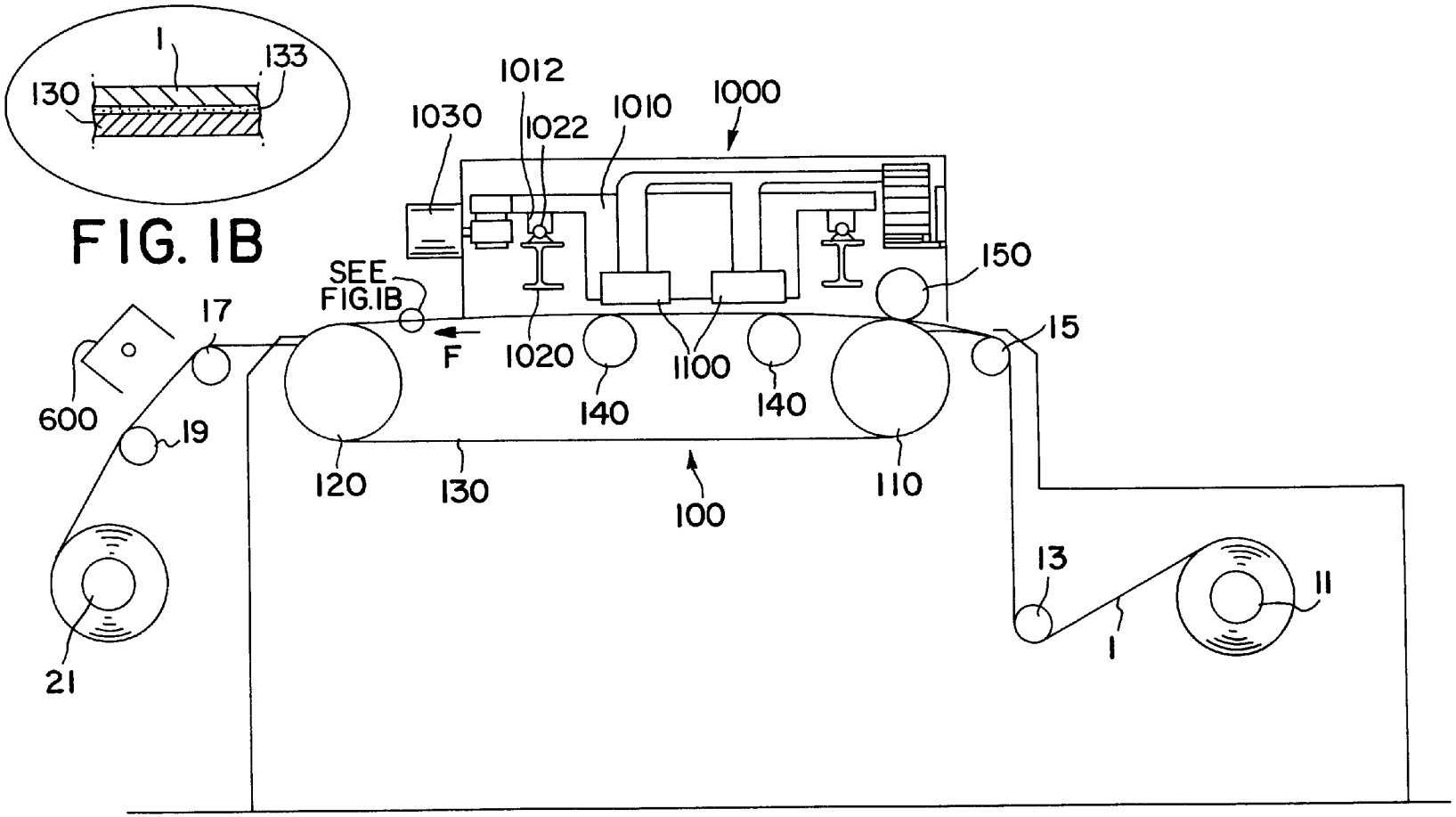
FIG. 1 is a sectional view of a textile-printing apparatus for explaining a construction of one of the preferred embodiments of the fluid-ejecting apparatus in accordance with the present invention.

FIG. 1 shows one example of a construction of an ink-jet printing apparatus as a fluid ejecting apparatus, for which the present invention is applied.

In the drawing, a cloth 1 as a recording medium (a print medium) is rolled out in accordance with the rotation of a roll-out roller 11. The cloth 1 moves toward a printer unit 100 through intermediate rollers 13 and 15.

In the printer unit 1000, a printing head 1100 prints an image on a surface of the cloth, which is transferred substantially in the horizontal direction (in the figure, indicated by the arrow F) by a transfer unit 100. As shown in the figure, the transfer unit 100 occupies a position with its face toward the printer unit 1000. After passing through the printer unit 1000, the fabric 1 is rolled around a roller 21 by a transport roller 17 and an intermediate roller 19. The transport unit 100 comprises rollers positioned upstream and downstream in the transport direction. That is, it comprises: two transport rollers 110 and 120, one upstream and another downstream, respectively; a transport belt 130 formed as a continuous band for conveying the cloth from one roller 110 to another 120; a pair of platen rollers 140 for keeping the print surface of the cloth flatter by holding it under a predetermined appropriate tension. In this embodiment, the transport belt 130 is of a metal type as disclosed in Japanese Patent Application Laid-Open No. 212851/1994. As shown in an enlarged view of FIG. 1, and adhesive layer (sheet) 133 is laminated on a surface of the transport layer 130. Thus, the cloth adheres to the adhesion layer 133 by sandwiching the cloth between the stick roller 150 and the transport roller 110 upstream of the printer 1000. Then the cloth, being flat, passes through the printer unit 1000. In such condition, the cloth can be printed by a specified printing agent ejected from printing heads 1100 mounted above the area between two separated platen rollers 140 which are placed between the transport rollers 110 and 120. After the printing, the cloth is stripped off from the adhesion layer 133 of the transport belt 130 at the transport roller 120 located downstream of the printer unit 1000. The removed cloth is moved further toward a winding roller 21. Consequently, the cloth is finally mount around the roller 21.

As shown in the figure, there are a drying heater 600 and two rollers 17, 19, in the conveying path between the transport roller 120 and the winding roller 21. The heater 600 is responsible for drying the printed cloth 1 supported by two rollers 17 and 19. In this embodiment, the drying heater can be selected from almost every kind of a drying device, such a dryer generating a warm current of air and a lamp radiating an infrared light beam.

The construction of the printer unit to be mounted on the fluid-ejecting apparatus in accordance with the present invention will be described below.

Figure 2:
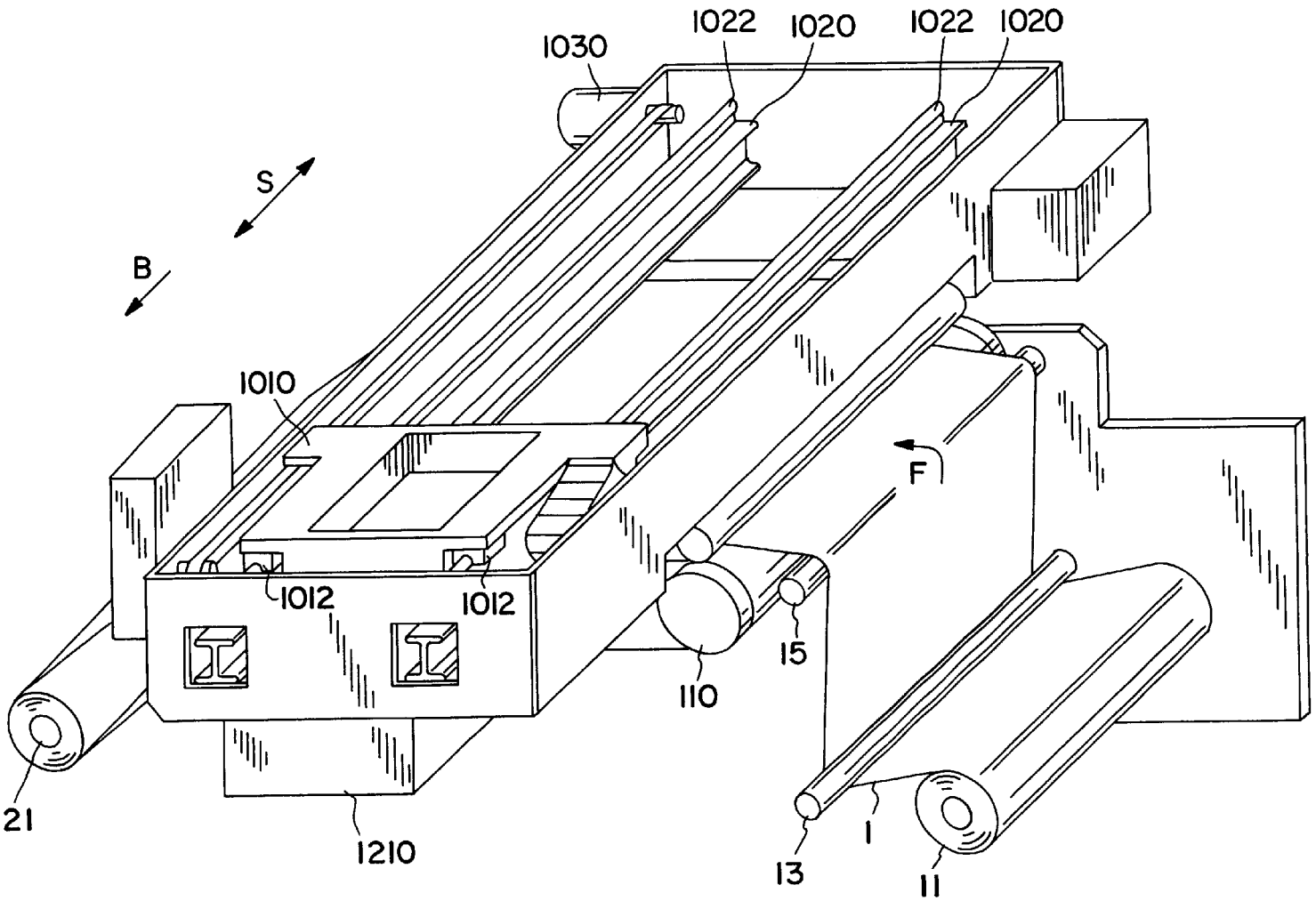
FIG. 2 is a perspective view of a printer unit of the textile-printing apparatus shown in FIG. 1.
Figure 3:
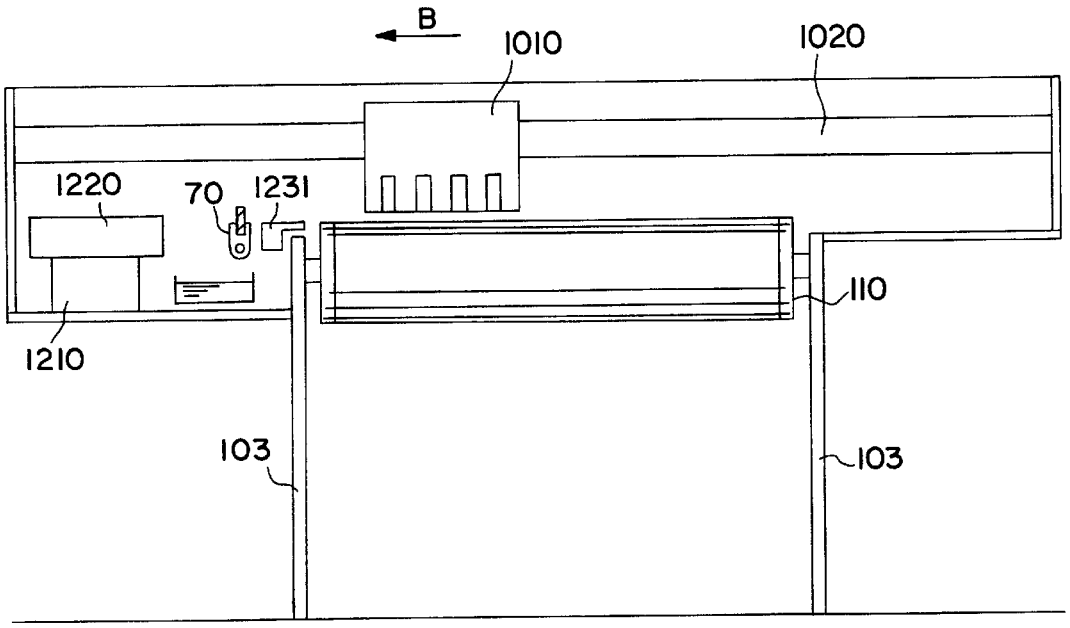
FIG. 3 is a side view of the printer unit shown in FIG. 2.

A perspective view, in schematic form, depicting the printer unit 1000 and the mechanism for transporting the cloth 1 is shown in FIG. 2. Also, a sectional view, in schematic form, depicting the carriage is shown in FIG. 3. Referring to FIG. 1, FIG. 2, and FIG. 3, we explain the construction of the printer unit in the paragraphs that follows.

As shown in FIG. 1 and FIG. 2, the printer unit 1000 comprises a carriage 1010 travelling in the direction differing from the direction (sub-scanning direction) of the arrow F. In this embodiment, for example, the carriage 1010 travels in the direction S (main-scanning direction) over the width of the cloth, perpendicular to the transport direction F. The carriage 1010 is supported by a support rail 1020 extending in the direction S. That is, the support rail 1020 supports a slide rail 1022 in which a slider 1012, fixed on the carriage, is secured.

Reference numeral 1030 denotes a motor as a driving means for moving the carriage 1010 in the main-scanning direction S. The carriage 1010 receives a driving force generated by the motor through a belt 1032 having a part thereof or another kind of a transmit mechanism on which the carriage is fixed.

The carriage 1010 comprises a plurality of printing heads 1100 having a plurality of elements for providing the print agent on the recording medium. These elements are arranged in a predetermined direction, for example, the transport direction F in the present embodiment. Also, the printing heads 1100 are arranged in a direction different from the above predetermined direction. In this embodiment, for example, two stages of the printing heads 1100 are formed in the transport direction. Each stage comprises a plurality of the printing heads 1100 in that each head corresponds to one of the different color agents to print color images on the recording medium. The number of the printing head and the number of colors to be required as the print agents can be determined, taking what one regards as appropriate for forming the color image on the cloth 1. For example, they correspond to yellow (Y), magenta (M), and cyan (C) which are three primary colors in printing, and also black (Bk). Alternatively or further, they may correspond to specific colors (i.e., metallic colors such as gold and silver, or vivid colors of red, blue, and so on). Furthermore, it is possible to use a plurality of print agents for only one color to change its concentration, gradually.

In the present embodiment, as shown in FIG. 1, a plurality of the printing heads 1100 is arranged in the main-scanning direction S and forms two stages in the transport direction F. In each stage, it is possible to make changes in the colors, the numbers, and the arrangements of the print agents of the printing heads in accordance with the images to be printed or the like. In the present embodiment, in addition, it is also possible to standardize the above factors in every stage. Furthermore, it is possible to drive the printing heads in the stages, independently. For example, the printing heads in the first stage are driven so as to print an image on a predetermined region in the cloth, while the printing heads in the second stage are driven so as to print an image on the same region after driving the first stage. That is, for example, it can be a complementary printing by making the image thinner with the printing head in each stage, or it can be a printing in which the images are printed, one on top of the other. In the present embodiment, as described above, two stages are used but the number of the stages is not confined within limits, for example, one or three stages, or more multiple stages can be used.

In the present embodiment, a "bubble-jet" printing head proposed by Canon Industrial Company can be used as the printing head 1100 in this type of ink-jet. The "bubble-jet" printing head comprises a plurality of thermal elements that generate thermal energy to be used for ejecting ink droplets by inducing a membrane-boiling phenomena in ink.

In the textile-printing apparatus, the ink-ejecting orifices of the printing head are provided as the elements for supplying the print agent and point downward, while the cloth 1 is provided so as to shift its position substantially in the horizontal direction by the transporting unit 100. Consequently, water heads among orifices cannot be varied and a uniform condition of ejecting ink from each orifice can be attained, resulting in an excellent image. In this case, furthermore, a uniform recovering process can be performed in all orifices.

In the period of non-printing movement, as shown in FIG. 3, a capping device 1220 contacts an ink-ejection surface of each printing head 1100. The ink-ejection surface is a part of the head 1100, on which a plurality of orifices for ejecting ink droplets are formed. In this condition, the capping device 1220 prevents the evaporation of the moisture content of the ink and prevents contact or mixture with extraneous substances, or recovers ink ejected from the printing head. To put it concretely, the printing head 1100 reaches a position facing against the capping device 1220 at the time of non-printing movement. Then the capping device 1220 shifts its position in the cap direction by a driving device 1210 to press an elastic body on the ink-injection surface of the printing head 1100.

A clog-preventing device 1231 receives ejected ink when the printing head 1100 performs an ink ejection (a preliminary ink ejection) to equalize the ejecting condition by replenishing the ink. In this embodiment, the clog-preventing device 1231 is placed at an outer part of the print region where the printing heads performs printing. In its place, the device 1231 fronts on the printing head. Also a fluid reservoir for absorbing the ink released by preliminary ink ejection is arranged between the capping device 1220 and the print region, and also it is arranged in the opposite position. In this embodiment, the fluid reservoir comprises a fluid preserver made of a sponge-like porous material or the like.

As shown in the figure, furthermore, a wiping blade 70 is provided between the capping device 1220 and the print region, which is able to move along the ink-ejection surface of the head with friction and pressure to remove water-drops, dust, and the like.

Figure 4:
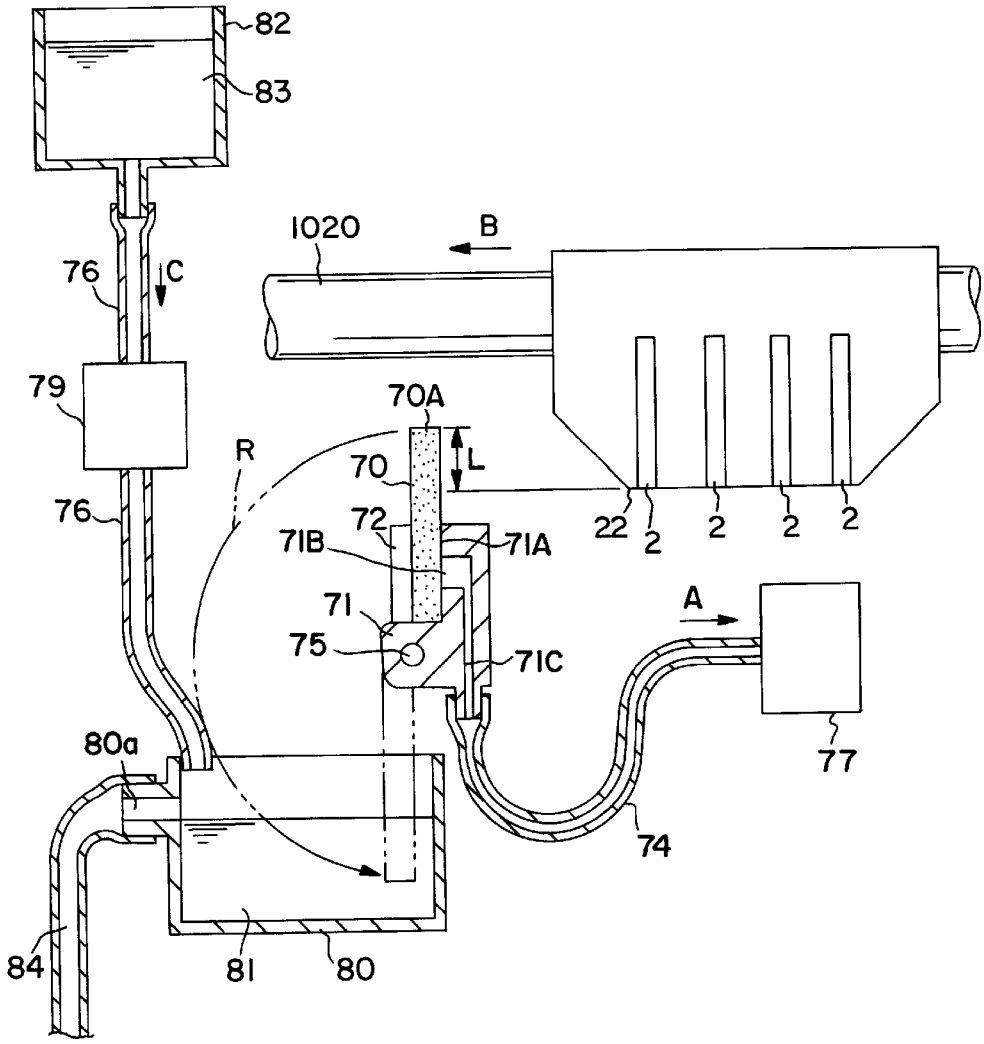
FIG. 4 is a schematic side view of a blade-cleaning means used for the fluid-ejecting apparatus of the present invention.

FIG. 4 is a schematic view of a washing device for cleaning the wiping blade 70.

In this embodiment, the wiping blade 70 is made of a plastic porous material. One of the appropriate materials for the blade is a high-molecular porous material, especially the one having the property of keeping its volume almost constant after and before absorbing mists of a fluid, such as ink. The preferable material is, for example, a high-molecular foam material, especially of the type of a formal resin foam.

In the present embodiment, it is possible to use a high-molecular porous body of the type of a material formed by thermal sintering, for example, a thermal sintered body made of a compound such as low-density polyethylene, high-density polyethylene, high molecular ethylene, complex polyethylene, polypropylene, polymethyl meta-acrylate, polystyrene, acrylonitrile copolymer, ethylene/vinyl acetate copolymer,fluororesin, and phenol resin. In these compounds, the low density polyethylene, high density polyethylene, high molecular weight polyethylene, and polypropylene are more preferable for preparing the wiping blade, because of their excellent properties of absorbing ink mist and their resistibility against chemicals in the ink.

In FIG. 4, reference numeral 71 denotes a holder in which the wiping blade is secured to a fixing plate 72. The holder 71 has an opening 71B in its surface 71A contacting the wiping blade 70. The opening 71B communicates with a suction tube 74 through a path 71C, so that an absorbed fluid, such as wash water and ink absorbed in the blade, can be drained in the direction of the arrow A by a suction means 77, such as a suction pump.

By the process of absorbing the wash fluid from the blade after the washing, the content of the wash fluid remaining in the blade can be decreased enough to approximately recover or maintain the blade's ability to absorb ink, debris, impurities, and the like. As a result, the blade achieves a more effective cleaning action against the ejection surface of the printing head, compared with that of the conventional blade.

A top end portion 70A of the wiping blade 70 is extruded over the level of the ejection surface of the fluid-ejecting head 2, corresponding to the length "L" in the figure. Therefore, the extruded portion of the blade 70 wipes the ejection surface of the head 2 when the head 2 scans in the direction of the arrow B.

After the step of wiping the head by the wiping blade 70, the wiping blade 70 turns around a rotation axis by 180° in the direction of the arrow R. Consequently, the top end portion (a wiping portion) 70A of the wiping blade 70 is immersed in a washing fluid 81 stored in a washing bath 80. In this case, the absorption tube 74 is made of a flexible material, so that the tube 74 is bent by a rotation of the blade 70 without preventing such rotation. The wash fluid is responsible for cleaning the blade 70 by removing and dissolving caked ink, debris, and impurities of the head's surface which are attached to the blade during the wiping step.

As shown in the figure, a reservoir 82 storing a flesh wash fluid 83 is located at a position higher than the washing bath 80. The reservoir 82 is responsible for supplying an additional wash fluid to the washing bath 80. An opening formed in a bottom of the reservoir communicates with a solenoid valve 79, so that the appropriate content of the flesh wash fluid flows into the washing bath 80 through a supply tube 76 by switching the valve 79 (in the figure, the flesh wash fluid 83 runs in the direction of the arrow C).

Furthermore, the washing bath 80 has an opening 80*a* in almost the middle of its side wall for draining the washing fluid out of the bath 80. When the wash fluid is supplied up to the opening 80*a*, the wash fluid flows out of the reservoir 82 through the opening 80*a* and runs into a drain tube 84 extending to the outside.

Figure 5:
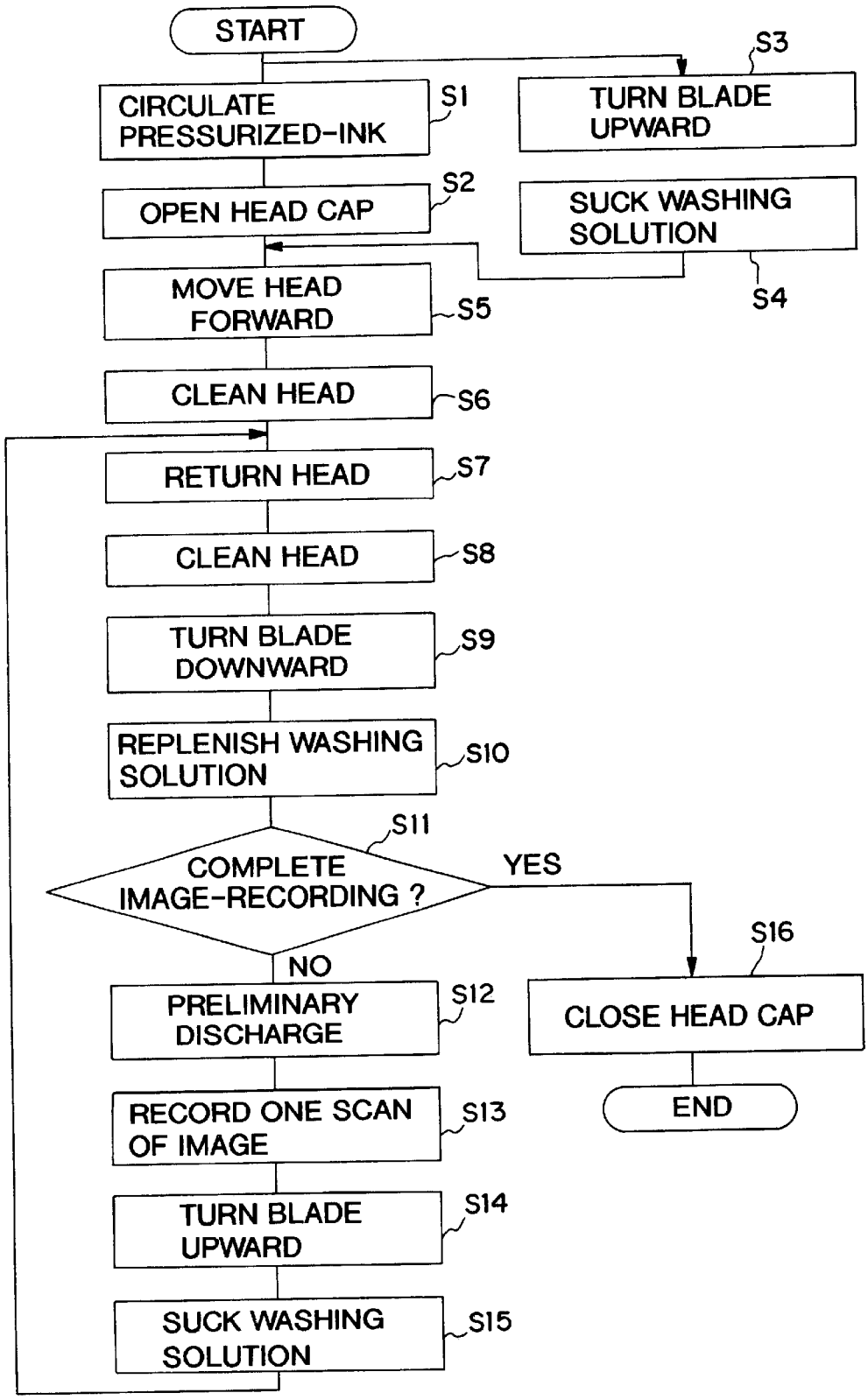
FIG. 5 is a simplified flow-sheet for explaining an operation sequence to be applied in the fluid-ejecting apparatus of the present invention.

FIG. 5 is a general flow chart of the printing process including the steps of cleaning the printing heads.

Before starting the print movement (i.e., during a standby period), the printing head is capped by a capping device 1220 and also a top end portion 70A of the wiping blade 70 is immersed in the wash fluid 81. In this period, the blade 70 is in the cleaned condition of being free from caked ink or impurities because these materials are removed from the blade and dispersed in the wash fluid.

In step 1 (S1), a pressurized circulation of ink is started when an input print signal is introduced into the printing apparatus from a control device, such as a host computer (not shown). In this step, bubbles in the ink and caked ink with a high viscosity or impurities are removed, and also ejection failure, caused by drying or caking of ink in the fluid passages or near the nozzles of the recording head, is eliminated, so as to smoothly eject ink droplets.

In step 2 (S2), the capping device (a head cap) is removed from the printing head 2.

In step 3 (S3), synchronously with the above second step, the blade turns upward to place its top end portion at the position for wiping the printing head.

In step 4 (S4), a certain content of the undesirable ink in the wiping blade 70 is forcibly removed by sucking means, such as a suction pump, resulting in lowering the fluid content of the blade to an appropriate level. Thus, the blade recovers its properties of capturing ink and impurities, so that the blade can be used repeatedly and effectively to clean the ejection surface of the printing head. For the blade is formed as a porous body as described above, and a capillary phenomenon occurs inside it by the above absorption process and at the same time a negative pressure can be generated. If the negative pressure of the blade is higher than that of the nozzles of the printing head, the following effects are observed. During the cleaning process, firstly, the ink tends to move from the printing head to the blade, so that the wash fluid does not flow into a fluid chamber of the printing head. In the blade, simultaneously, the abilities of absorbing ink in the nozzle can be increased, so that a highly-viscous portion of ink in the nozzle can be removed by the cleaning process.

In step 5 (S5), the carriage 1010 is driven and the printing head moves back and forth in the main-scanning direction.

In step 6 (S6), the ejection surface of the head is cleaned off during the passing of the carriage through the cleaning device 50. In this step, that is, the wiping blade 70 wipes the ejection surface of the printing heads, one after another. In the present embodiment, the term "wipe" or "wiping" means that the ejection surface of the printing head is subjected to light rubbing or friction, with the blade, in order to clean or dry the surface by removing the wash fluid, ink, dirt, impurities, and the like.

Figure 6:
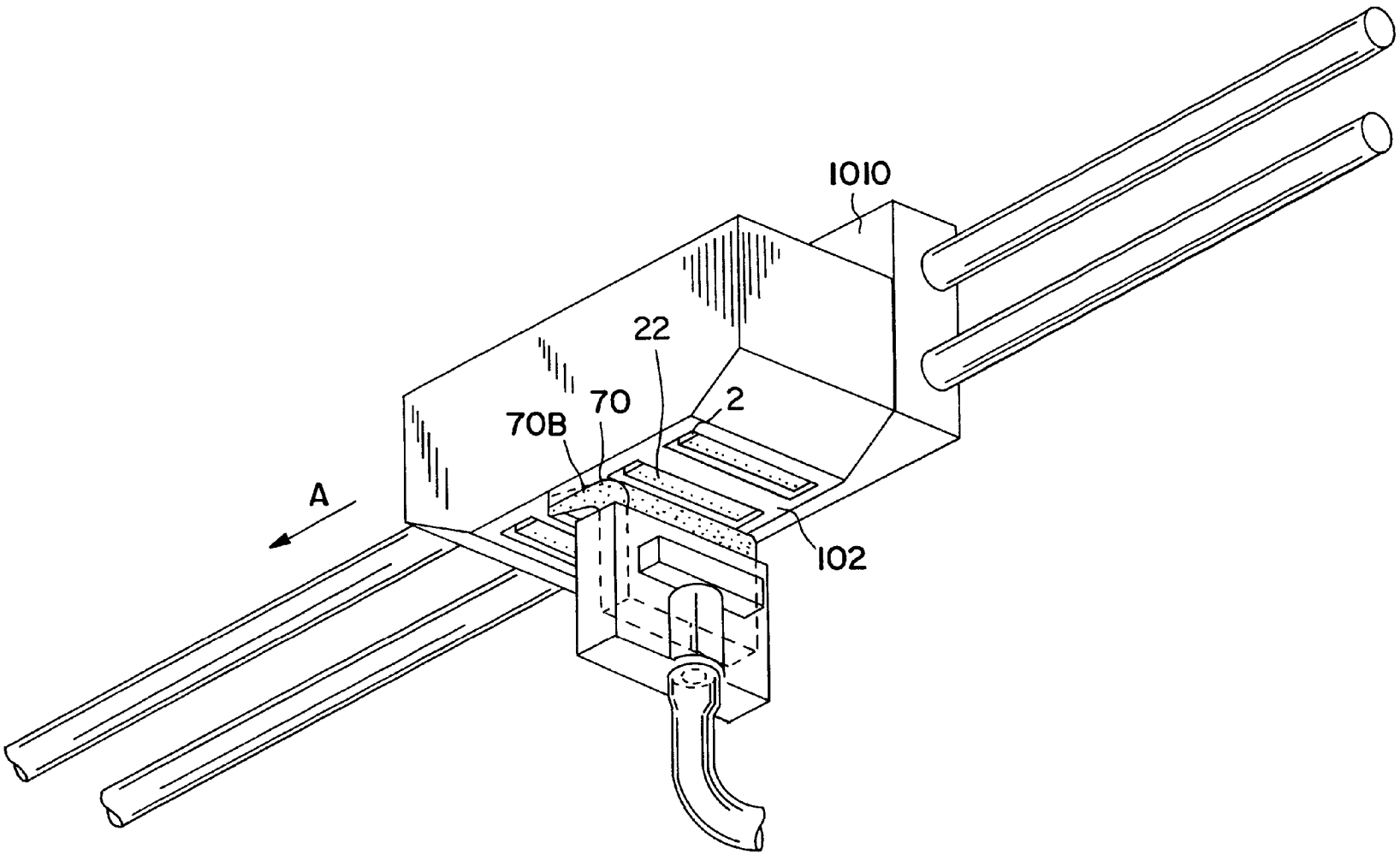
FIG. 6 is a perspective view of a wiping blade and a printing head for explaining their relationship to be applied in the textile-printing apparatus in accordance with the present invention.

As shown in FIG. 6, the wiping blade 70 bends in the same direction as that of the arrow A (i.e., the direction in which the carriage moves). Because of its light elasticity, the blade 70 bends back in the opposite direction to wipe and clean the ejection surface 22 of the printing head. Therefore, the cleaning effects cannot be influenced by a difference in the level between the holder's surface 102 and the ejection surface 22.

In step 7 (S7), the carriage starts to move back.

In step 8 (S8), the printing head is subjected to the cleaning process again. In this period, the ejection surface of the printing head can be wiped by another side 70B of the wiping blade. This means that the printing head cannot be polluted by the polluted surface of the blade. In accordance with the present embodiment, therefore, the cleaning process is performed during the back and forth movement of the carriage. In this case, it is noted that the cleaning effects are not decreased but doubled.

In step 9 (S9), the blade shifts from the date of cleaning the printing head to the state of washing itself. That is, the blade turns downward to the position where the blade is subjected to the washing process in which the top end portion of the blade is immersed into the wash fluid in the bath.

In step 10 (S10), the content of wash fluid is kept constant because new fluid is supplied to the bath by opening or closing the solenoid valve 79. By this supplement of new fluid, the polluted wash fluid is gradually diluted and flows off the bath through the outlet at a constant rate. Consequently, the concentration of the contaminant in the wash fluid can be kept at a constant or under a predetermined level and cannot be increased.

According to the above construction, the present embodiment makes the best use of the wash fluid. That is, the tank successively supplies a minimum content of the wash fluid in need of the supplement and thus it is possible to keep the use of the wash fluid to a minimum. In the present embodiment, furthermore, it is possible to maintain the good stability of the washing process because the top end portion of the blade is immersed into the wash fluid.

A part of the supplied fluid flows out of the bath through the outlet to keep the surface of the wash fluid at a constant level. The overflowing fluid is discharged from the drain to the outside of the apparatus.

In step 11 (S11), the apparatus judges whether the printing of the whole image data to be printed is terminated.

In step 12 (S12), if it is not terminated, the printing head starts to eject ink droplets to the block-preventing device 1231 for the constant period.

In step 13 (S13), the carriage moves in the direction of the arrow A, together with ejecting ink droplets from the head to record an image as a pattern of a dot matrix on an area P of the recording medium corresponding to a recording width of the head.

In step 14 (S14), the blade turns upward before the carriage moves back to the wiping position of the blade.

In step 15 (S15), the wash fluid in the blade is absorbed by the suction means to recover the cleaning ability of the blade. Then the carriage 1010 moves back in the direction of the arrow B and returns to the position of wiping the head. The recording medium 1 shifts in an extent of the recording width in the direction of the arrow F.

In step 16 (S16), on the other hand, the ejection surface 22 of the head is sealed by capping with the capping device 20 when image formation terminated ("YES" in the step of S11). In this embodiment, the wiping blade is made of a plastic porous body as described above, but is not limited thereto. For example, a conventional rubber blade can be also used as the blade of the present embodiment. In this case, a combination of the conventional rubber blade and the washing device may also provide more excellent cleaning effects compared with that of the conventional wiping.

In the above description, furthermore, the device is constructed for cleaning of the ejection surface of the head by the wiping blade after absorbing the wash fluid in the wiping blade. However, it may be possible to perform the process of cleaning the ejection surface of the head at the same time as performing the process of absorbing the wash fluid in the wiping blade. It can be effective when the content of undesired ink, wash fluid, or the like adhering to the rejection surface of the head is greater than usual.

In the case that the back movement of the carriage is enough to complete the cleaning of the ejection surface of the head by the cleaning device, it is possible to increase the entire printing speed by omitting the cleaning process during the period of moving the head forth. The cleaning process can be missed by the following steps when the head moves forward in the main-scanning direction (S5). That is, keeping the wiping blade at the present position (S3), excluding the process of cleaning the head (S6), turning the blade upward (S3), and absorbing the ink in the blade (S4).

EXAMPLE 2

Figure 7:
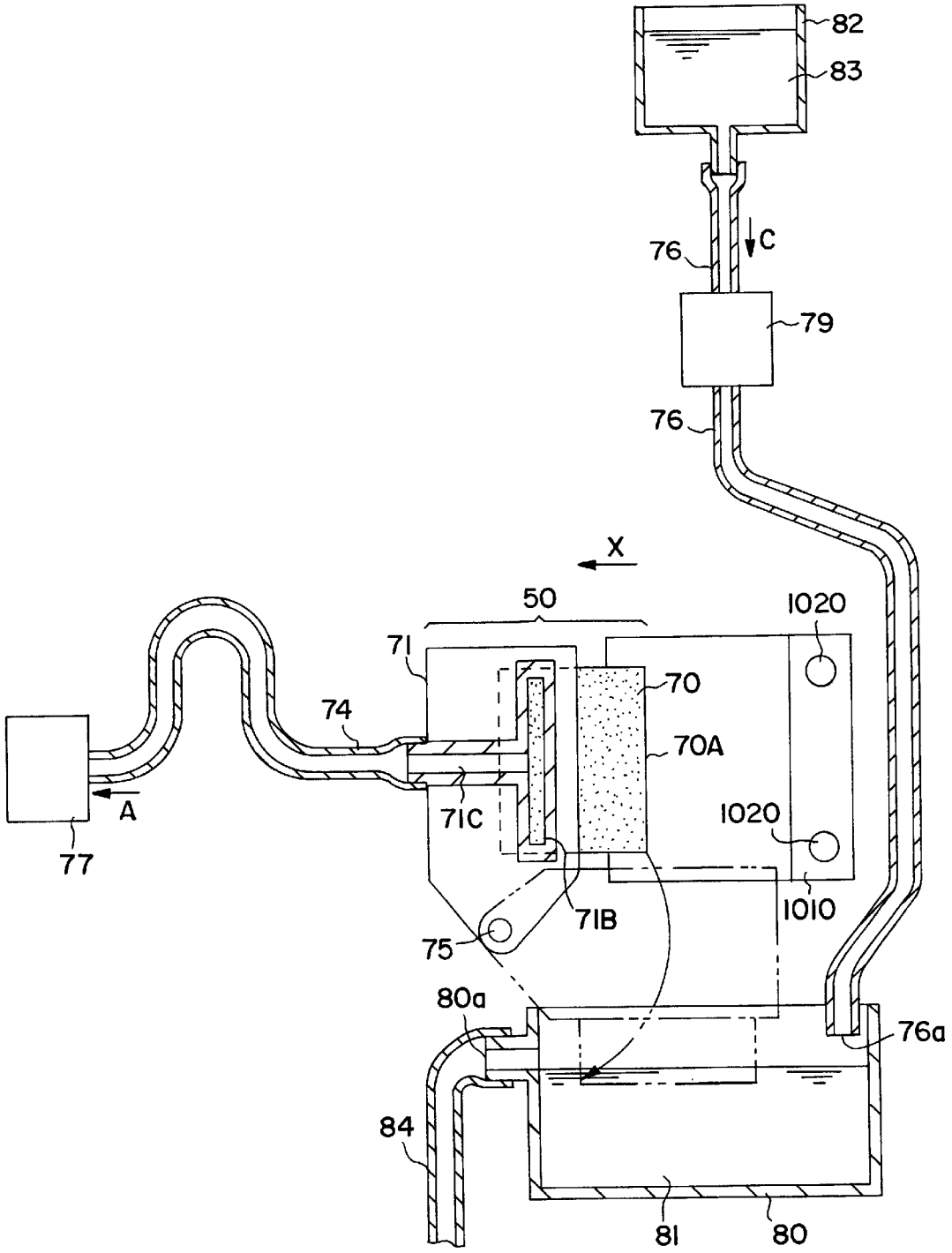
FIG. 7 is a side view of a blade-cleaning device to be applied in the fluid-ejecting apparatus of the present invention in that the printer unit ejects ink drops in the horizontal direction.

FIG. 7 is a schematic side view of the blade-cleaning device to be applied in the fluid-ejecting apparatus as a second preferred embodiment of the present invention. In this embodiment, the printer unit ejects ink droplets in the horizontal direction of the arrow X. Just as in the case of the first embodiment, as shown in the figure, the present embodiment has a wiping blade 70 revolving 90° around an axis 75 to immerse the top end 70*a* of the head into the wash fluid 81.

EXAMPLE 3

Figure 8:
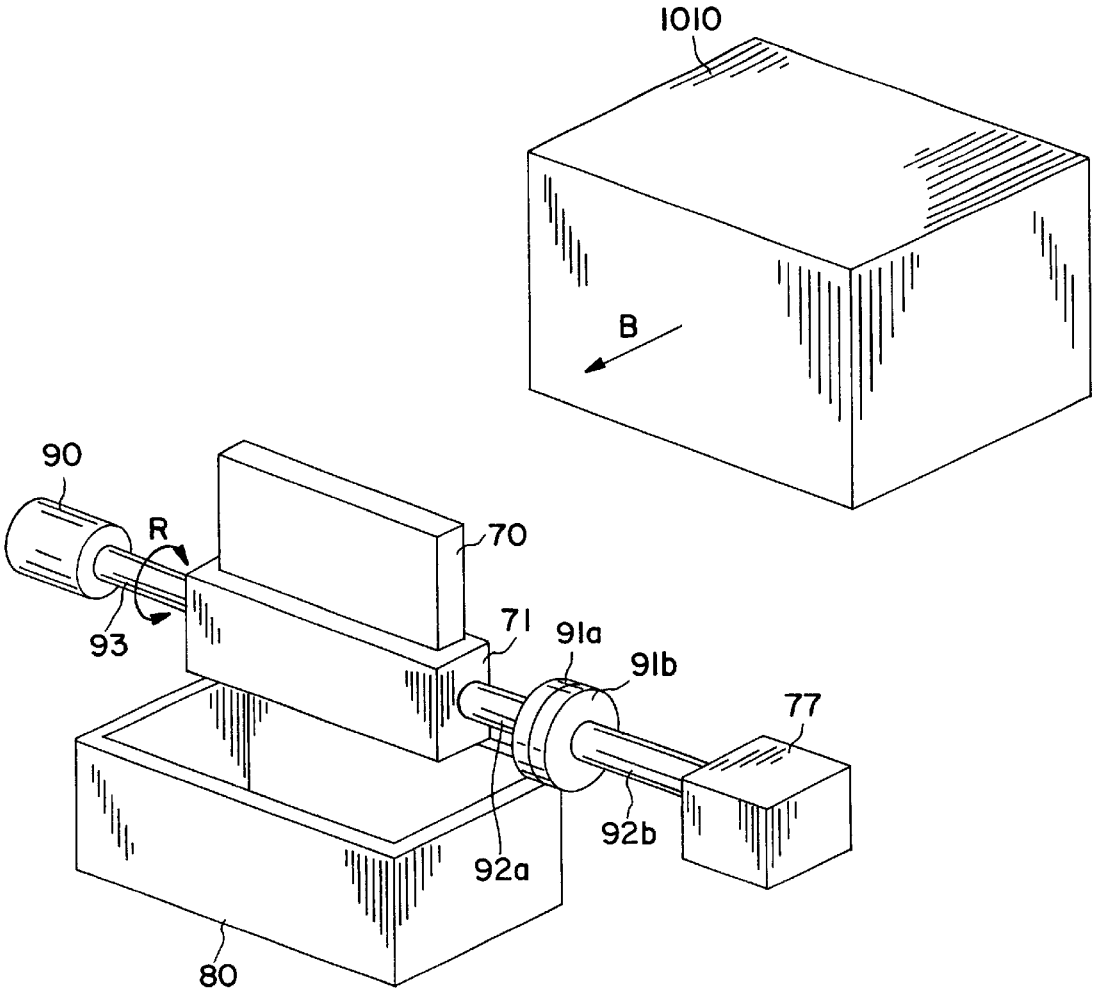
FIG. 8 is a perspective view of a driving means for driving a wiping blade to be installed in the fluid-ejecting apparatus of the present invention.

FIG. 8 is a perspective view of a driving device for revolving the wiping blade 70 to be applied in the fluid-ejecting apparatus as a third preferred embodiment of the present invention.

A driving shaft 93 of the driving device 90 is secured at a side of the holder 71 and allows the wiping blade 70 and the holder 7 in a body to be revolved through a predetermined angle in the direction of the arrow R. A suction pipe 92*a* for absorbing the wash fluid in the wiping blade 70 is secured to an opposite side of the holder 71. Furthermore, the absorption device 77 withdraws the wash fluid passing through joint members 91*a*, 91*b*, and through an absorption tube 92*b* to be absorbed by the absorbing device 77. In this embodiment, the joint members 91*a*, 91*b*, are able to rotate, respectively, and the absorption tubes 92*a*, 92*b* are kept airtight.

In this embodiment, the absorption pipes 92*a*, 92*b* are not of the flexible type shown in the first example, so that the tubes can be broken or damaged.

It is noted that the fluid-ejecting apparatus described above is able to connect with a control-means for constructing a textile-printing system. In the system, the control means is responsible for controlling an image-recording (printing) behavior of the apparatus. In general, a personal computer or the like can be used as the above control means to unify input and output signals of the image data or control signals for controlling the movement of printer unit, transporting unit, and so on. Accordingly, the concrete construction of the textile-printing system comprising the fluid-ejecting apparatus of the present invention may be easily made without departing from the invention by the person skilled in the art.

As described in detail in the above examples, the fluid-ejecting apparatus in accordance with the present invention may produce the following effects.

(1) A stable and uniform washing of the wiping blade having a long width can be attained by the process including the step of immersing the wiping blade in a wash fluid stored in a washing bath.

(2) For supplying a washing fluid of constant content into the washing bath, a much lower amount of wash fluid is used for washing the wiping blade than that of the conventional method in which the blade is directly washed by a flow of the wash fluid.

(3) For performing a periodical supplement of the wash fluid and a discharge of an excess portion of the wash fluid, the level of the wash fluid in the washing bath is always kept constant in spite of changing the content of the wash fluid to be used in the process of washing the blade.

(4) For employing the ink-jet recording method, the fluid-ejecting apparatus of the present invention is able to provide an output of high density and high quality images, with a small sized construction, and produces fine color prints by using color inks, and also it is able to perform not only high speed printing but also noiseless printing.

VARIOUS ASPECTS OF THE INVENTION

The present invention achieves a distinct effect when applied to a printing head or a printing apparatus of the type using a "bubble-jet" method proposed by Canon Industrial Company, which has means for generating thermal energy, such as electrothermal transducers or laser light, and which causes changes in ink by the thermal energy so as to eject ink. This is because such a system can achieve a high density and high refluid recording.

A typical structure and operational principle thereof is disclosed in U.S. Pat. Nos. 4,723,129 and 4,740,796, and it is preferable to us this basic principle to implement such a system. Although this system can be applied either to on-demand type or continuous-type ink jet recording systems, it is particularly suitable for the on-demand apparatus. This is because the on-demand type apparatus has electrothermal transducers, each disposed on a sheet or fluid passage that retains fluid (ink), and operates a follows: first, one or more drive signals are applied to the electrothermal transducers to cause thermal energy to be generated corresponding to recording information; second, the thermal energy induces a sudden temperature rise that exceeds the nucleate boiling point of the ink so as to cause film boiling on heating portions of the recording head; and third, bubbles are grown in the fluid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions be as described in U.S. Pat. No. 4,313,124.

The structure of the recording head may be as shown in U.S. Pat. Nos. 4,558,333 and 4,459,600, which is incorporated in the present invention. This structure includes heating portions disposed on bent portions in addition to a combination of the ejection orifices, fluid passages and the electrothermal transducers disclosed in the above patents. However, the present invention can be applied to structures disclosed in Japanese Patent Application Laid-Open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

Furthermore, although the above-described embodiments use fluid ink, inks that are fluid when the recording signal is applied can be used: for example, inks can be employed that solidify at a temperature lower than room temperature and are softened or liquefied at room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the fluid state, and then begins to solidify on hitting the recording medium, thereby preventing ink evaporation: the ink is transformed from a solid to a fluid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as fluid or solid substances so that the ink faces the electrothermal transducers as described in Japanese Patent Application Laid-Open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Next, in the case that the present invention is applied to textile printing, the following performatory characteristics are required for the textile so as to be suitable for the ink jet textile printing:

(1) colors should come out on ink in a sufficient density;

(2) the dye fixation factor is high for ink;

(3) the ink must be dried quickly;

(4) The generation of irregular ink spread is limited; and (5) feeding can be conducted in an excellent condition in an apparatus.

In order to satisfy these requirements, it may be possible to give a preparatory treatment to the textile used for printing, as required. In this respect, a textile having an ink receptacle layer is disclosed in Japanese Patent Application Laid-Open No. 53492/1987, for example. Also, in Japanese Patent Application Publication No. 46589/1991, there are proposed the textile which contains reduction preventive agents or alkaline substances. As an example of such a preparatory treatment as this, it is also possible to name a process to allow the textile to contain a substance selected from an alkaline substance, a water soluble polymer, a synthetic polymer, a water soluble metallic salt, or urea and thiourea.

As an alkaline substance, there can be used, for example, hydroxide alkali metals such as sodium hydroxide, potassium hydroxide; mono-, di-, and tri-ethanol amine, and other amines; and carbonate or hydrogen carbonate alkali metallic salt such as sodium carbonate, potassium carbonate, and sodium hydrogen carbonate. Furthermore, there are organic acid metallic salts such as calcium carbonate, barium carbonate or ammonia and ammonia compounds. Also, there can be used sodium trichloroacetic acid and the like which become an alkaline substance by steaming and hot air treatment. For the alkaline substance which is particularly suitable for the purpose, there are sodium carbonate and sodium hydrogen carbonate, which are used for dye coloring of reactive dyestuffs.

As a water soluble polymer, there can be used starchy substances such as corn and wheat; cellulose substances such as carboxyl methyl cellulose, methyl cellulose, hydroxy ether cellulose; polysaccharides such as sodium alginic acid, gum arabic, locasweet bean gum, tragacanth gum, guar gum, and tamarind seed; protein substances such as gelatin, and casein; and natural water soluble polymers such as tannin and lignin.

Also, as a synthetic polymer, there can be named, for example, polyvinylalcoholic compounds, polyethylene oxide compounds, acrylic acid water soluble polymer, maleic anhydride water soluble polymer, and the like. Among them, polysaccharide polymers and cellulose polymers should be preferable.

As a water soluble metallic salt, there can be named the pH 4 to 10 compounds which produce typical ionic crystals, namely, halogenoid compounds of alkaline metals or alkaline earth metals, for example. As a typical example of these compounds, NaCl, $Na_2SO_4$, KCl and $CH_3COONa$ and the like can be named for the alkaline metals, for example. Also $CaCl_2$, $MgCl_2$, and the like can be named for the alkaline earth metals. Particularly, salt such as Na, K, and Ca should be preferable.

In the preparatory process, a method is not necessarily confined in order to enable the above-mentioned substances and others to be contained in the textile. Usually, however, a dipping method, a padding method, a coating method, a spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process, such as this can be a method publicly known in the art. There can be used a steaming method, an HT steaming method, and a thermofixing method, for example. Also an alkaline pad steaming method, an alkaline blotch steaming method, an alkaline shock method, an alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted. In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. The methods of machine stitching the textile to make clothes and material to satisfy other daily needs are disclosed widely in publicly known publications.

In addition, the present invention is effectively applicable to a replaceable chip type printing head which is connected electrically with the main apparatus and can be supplied with ink when it is mounted in the main assembly, or to a cartridge type printing head having an integral ink container.

Furthermore, as a printing mode for the printing apparatus, it is not only possible to arrange a monochromatic mode mainly with black, but also it may be possible to arrange an apparatus having at least one of a multi-color mode with different color ink materials and/or a full-color mode using a mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as a fluid, it may be an ink material which is solidified below room temperature but liquefied at room temperature or it may be a fluid. Since the ink is controlled with a temperature not lower than 30° C. and not higher than 70° C. to stabilize its viscosity for the provision of the stable discharge in general, the ink may be such that it can be liquefied when the applicable printing signals are given.

In addition, while preventing a temperature rise due to the thermal energy by the positive use of such energy as energy consumed for changing the state of the ink from solid to fluid, or using the ink which will be solidified when left intact for the purpose of preventing ink evaporation, it may be possible to apply to the present invention the use of an ink which is liquefied only by the application of thermal energy, such as an ink capable of being discharged as ink fluid by enabling itself to be liquefied anyway when the thermal energy is given in accordance with the printing signals, and an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus, such as a word processor and a computer.

Further, as a medium to be printed, cloth, wall cloth, embroidery yarn, wall paper, paper, OHP film, and so on can be named. Cloth can include all fabrics, nonwoven fabric and other textile materials irrespective of their materials and method of weaving or knitting therefor.

The present invention has been described in detail with respect to the preferred embodiments, and it will now be evident that changes and modifications may be made without departing from the invention in its broader aspects, and it is the intention, therefore, in the appended claims to cover all such changes and modifications as fall within the true spirit of the invention.

What is claimed is:

1. A fluid-ejecting apparatus for ejecting a specified fluid to a recording medium by using a fluid-ejecting head having an ejection surface where a plurality of orifices for ejecting the specified fluid are formed, comprising:

wiping means having a wipe member, the wipe member having a wiping area for wiping said ejection surface of the fluid-ejecting head during contact with said ejection surface, the wipe member consisting of a porous member, and the wipe member shaped for providing substantially uniform pressure on said ejection surface during contact with said ejection surface;

a washing bath storing a wash fluid for washing at least said wipe member of said wiping means;

absorption means for absorbing the fluid in said wipe member after washing at least said wipe member;

transport means for moving said wiping means between an upward position where said wiping means wipes said ejection surface of the fluid-ejecting head with the wiping area of said wipe member, and in which said wiping means does not contact the wash fluid stored in said washing bath, and a downward position where the entire wiping area of said wipe member is dipped into said wash fluid stored in said washing bath and is washed thereby, and in which the fluid-ejecting head does not contact said wiping means;

supply means for supplying an additional wash fluid to said washing bath; and discharging means for discharging a portion of the wash fluid from said washing bath.

2. An apparatus as claimed in claim 1, further comprising discharge means for discharging a portion of the wash fluid when a content of said wash fluid in said washing bath exceeds a prescribed level in order to keep an amount of the wash fluid in said washing bath to a constant level.

3. An apparatus as claimed in claim 1, wherein said wipe member is made of a plastic member.

4. An apparatus as claimed in claim 3, wherein said plastic member occupies a predetermined volume and is composed of a high molecular porous body which maintains a constant volume when absorbing the specified fluid, and wherein said high molecular porous body comprises a formal foam resin.

5. An apparatus as claimed in claim 3, wherein said plastic member is a thermal sintered compound selected from the group consisting of low-density polyethylene, high-density polyethylene, high-molecular polyethylene, complex polyethylene, polypropylene, polymethyl meta-acrylate, polystyrene, acrylonitrile copolymer, ethylene/vinyl acetate copolymer, fluororesin, and phenol resin.

6. An apparatus as claimed in claim 1, further comprising absorption means for absorbing fluid in said wipe member.

7. An apparatus as claimed in claim 6, wherein an absorption force of said absorption means is sufficient to cause fluid to flow from said orifices of said fluid-ejecting head through said wiping means when said ejection surface is wiped by said wipe member.

8. An apparatus as claimed in claim 1, wherein said fluid-ejecting head is moved back and forth against a recording surface of the recording medium to perform recording by ejecting the specified fluid, and said wiping means has a first surface for wiping said ejection surface of said fluid-ejecting head when said fluid-ejecting head is moved forth and a second surface for wiping said ejection surface of said fluid-ejecting head when said fluid-ejecting head is moved back.

9. An apparatus as claimed in claim 1, wherein said fluid-ejecting head is a full color recording head, composed of a plurality of head portions being different from each other to correspond to a plurality of colors.

10. An apparatus as claimed in claim 1, wherein said fluid-ejecting head is an ink-jet recording head having a plurality of nozzles for ejecting the specified fluid.

11. An apparatus as claimed in claim 10, wherein said ink-jet recording head has a plurality of thermal-energy conversion elements for generating thermal energy, the thermal energy being applied to the specified fluid to perform the ejection.

12. An apparatus as claimed in claim 11, wherein said fluid-ejecting head ejects the specified fluid from said plurality of orifices by causing a conditional change in the specified fluid by the thermal energy generated by said thermal-energy conversion elements.

13. An apparatus as claimed in claim 1, wherein the recording medium is a cloth.

14. An apparatus as claimed in claim 1, wherein the wipe member has a flat surface parallel to said ejection surface of the fluid-ejecting head.

15. A print system comprising:

a transport unit for transporting a textile; and a textile-printing apparatus for printing the textile, wherein said textile-printing apparatus comprises:

a fluid-ejecting head having an ejection surface ejecting a specified fluid;

wiping means having a wipe member, the wipe member having a wiping area for wiping the ejection surface of said fluid-ejecting head during contact with said ejection surface, the wipe member consisting of a porous member, and the wipe member shaped for providing substantially uniform pressure on said ejection surface during contact with said ejection surface;

a washing bath storing a wash fluid for washing at least said wipe member of said wiping means;

absorption means for absorbing the fluid in said wipe member after washing at least said wipe member;

transport means for moving said wiping means between an upward position where said wiping means wipes said fluid-ejecting head with the wiping area of said wipe member, and in which said wiping means does not contact the wash fluid stored in said washing bath, and a downward position where the entire wiping area of said wipe member is dipped into said wash fluid stored in said washing bath and is washed thereby, and in which said fluid-ejecting head does not contact said wiping means;

supply means for supplying an additional wash fluid to said washing bath; and discharging means for discharging a portion of the wash fluid from said washing bath.

16. A print system as claimed in claim 15, wherein the wipe member has a flat surface parallel to said ejection surface of the fluid-ejecting head.

17. A method of recovering a specified fluid from a fluid-ejecting head for ejecting a specified fluid to a recording medium, comprising the steps of:

providing wiping means for wiping an ejection surface of the fluid-ejecting head, the wiping means having a wipe member consisting of a porous member;

wiping the ejection surface of the fluid-ejecting head with a wiping area of the wipe member of the wiping means, the wipe member shaped for providing substantially uniform pressure on said ejection surface during contact with said ejection surface;

moving the wiping means from an upward position where the wiping means wipes the fluid-ejecting head with the wiping area of the wipe member to a downward position where the entire wiping area of the wipe member is dipped into a wash fluid stored in a washing bath and is washed thereby;

washing at least the wipe member of the wiping means by immersing the wipe member in the wash fluid in the washing bath;

absorbing the fluid in the wipe member by using absorption means after washing at least the wipe member;

supplying an additional wash fluid to said washing bath; and discharging a portion of the wash fluid from said washing bath in order to keep an amount of the wash fluid in said washing bath to a constant level, wherein, at the upward position, the wiping means does not contact the wash fluid stored in the washing bath, and, at the downward position, the fluid-ejecting head does not contact the wiping means.

18. A method as claimed in claim 17, further comprising the step of discharging a portion of the wash fluid when a content of said wash fluid in said washing bath exceeds a prescribed level with an additionally supplied wash fluid.

19. A method as claimed in claim 17, wherein said providing step further comprises the step of providing a plastic wipe member.

20. A method as claimed in claim 19, wherein the plastic wipe member has a high molecular porous body, the high molecular porous body being a formal foam resin, and said method further comprises the step of absorbing the specified fluid while maintaining a constant volume of the plastic wipe member.

21. A method as claimed in claim 19, wherein said providing step comprises the step of providing a plastic wipe member made of a thermal sintered compound selected from the group consisting of low density polyethylene, high-density polyethylene, high-molecular polyethylene, complex polyethylene, polypropylene, polymethyl meta-acrylate, polystyrene, acrylonitrile copolymer, ethylene/vinyl acetate copolymer, fluororesin, and phenol resin.

22. A method as claimed in claim 17, wherein said washing step further comprises the step of absorbing the specified fluid in the wipe member with an absorption means.

23. A method as claimed in claim 22, wherein said absorbing step comprises the step of applying a sufficient absorption force to cause the specified fluid to flow from orifices of the fluid-ejecting head through the wiping means when an ejection surface of the fluid-ejecting head is wiped by the wipe member in said wiping step.

24. A method as claimed in claim 17, further comprising the steps of:

moving the fluid-ejecting head back and forth against a recording surface of the recording medium to perform recording by ejecting the specified fluid, and wiping the ejection surface of the fluid-ejecting head with a first surface of the wipe member when the fluid-ejecting head is moved forth and wiping the ejection surface of the fluid-ejecting head with a second surface of the wipe member when the fluid-ejecting head is moved back.

25. A method as claimed in claim 17, further comprising the step of providing a full color fluid-ejecting head composed of a plurality of head portions being different from each other to correspond to a plurality of different colors.

26. A method as claimed in claim 25, wherein said providing step comprises the step of providing an ink-jet recording head having a plurality of thermal-energy conversion elements for generating thermal energy, the thermal energy being applied in said fluid to perform said ejection.

27. A method as claimed in claim 17, further comprising the step of providing an ink-jet recording head having a plurality of nozzles for ejecting the specified fluid as the fluid ejecting head.

28. A method as claimed in claim 27, further comprising the step of ejecting the specified fluid from the fluid-ejecting head from orifices by causing a conditional change in the specified fluid by the thermal energy generated by the thermal-energy conversion elements.

29. A method as claimed in claim 17, further comprising the step of providing cloth as the recording medium.

30. A method according to claim 17, wherein the wipe member has a flat surface parallel to said ejection surface of the fluid-ejecting head.

31. A record product comprising the combination of a recording medium and a textile printing apparatus comprising a fluid-ejecting apparatus ejecting a plurality of fluid droplets at least on one surface of said recording medium, wherein said fluid-ejecting apparatus comprises an ejection surface with a plurality of orifices for ejecting the fluid droplets, said fluid ejecting apparatus further comprising:

wiping means having a wipe member, the wipe member having a wiping area for wiping the ejection surface during contact with said ejection surface, the wipe member consisting of a porous member, and the wipe member shaped for providing substantially uniform pressure on said ejection surface during contact with said ejection surface;

a washing bath storing a wash fluid for washing at least said wipe member of said wiping means;

absorption means for absorbing the fluid in said wipe member after washing at least said wipe member;

transport means for moving said wiping means between an upward position at which said wiping means wipes the ejection surface with the wiping area of said wipe member, and in which said wiping means does not contact the wash fluid in said washing bath, and a downward position where the entire wiping area of said wipe member is dipped into the wash fluid in said washing bath and is washed thereby, and in which the ejection surface does not contact said wiping means;

supply means for supplying an additional wash fluid to said washing bath;

discharge means for discharging a portion of the wash fluid in said washing bath in order to keep an amount of the wash fluid in said washing bath to a constant level, thereby providing a washed wipe member for wiping the ejection surface for improved ejecting of fluid droplets to perform recording.

32. A record product according to claim 31, wherein the wipe member has a flat surface parallel to said ejection surface of the fluid-ejecting head.

* * * * *

UNITED STATES PATENT AND TRADEMARK OFFICE

CERTIFICATE OF CORRECTION

PATENT NO. : 6,257,697 B1
DATED : July 10, 2001
INVENTOR(S) : Mitsuru Kurata

It is certified that error appears in the above-identified patent and that said Letters Patent is hereby corrected as shown below:

Title page,
Item [56], References Cited, FOREIGN PATENT DOCUMENTS, "5212851 8/1993 (JP)" should read -- 5-212851 8/1993 (JP) --;
"404278358 10/1992 (JP)" should read -- 4-4278358 10/1992 (JP) -- and please insert -- 5-31905 2/1993 (JP) --.

Column 4,
Line 24, "for wiping, for wiping" should read -- for wiping --.

Column 5,
Line 24, "for wiping, for wiping" should read -- for wiping --.

Column 7,
Line 6, "moved further" should read -- further moved --.

Column 8,
Line 55, "its" should read -- this --.

Column 9,
Line 18, "copolymer,fluororesin," should read -- copolymer, fluororesin, --.

Column 11,
Line 10, "date" should read -- state --;
Line 13, "which" should read -- that --;
Line 20, "off" should read -- off of --; and
Line 52, "The" should read -- Then the --.

Column 12,
Line 4, "rejec-" should read -- ejec- --.

UNITED STATES PATENT AND TRADEMARK OFFICE

CERTIFICATE OF CORRECTION

PATENT NO. : 6,257,697 B1
DATED : July 10, 2001
INVENTOR(S) : Mitsuru Kurata

It is certified that error appears in the above-identified patent and that said Letters Patent is hereby corrected as shown below:

Column 13,
Line 55, "However," should read -- Moreover, --.

Signed and Sealed this

Eleventh Day of June, 2002

*Attest:*

*Attesting Officer*

JAMES E. ROGAN
*Director of the United States Patent and Trademark Office*